United States Patent [19]

Campana

[11] Patent Number: 4,896,378

[45] Date of Patent: Jan. 30, 1990

[54] PROTECTIVE WRIST BAND

[76] Inventor: Donald R. Campana, P.O. Box 476, Commerce City, Colo. 80037

[21] Appl. No.: 249,583

[22] Filed: Sep. 26, 1988

[51] Int. Cl.[4] ..... A41D 13/08

[52] U.S. Cl. ..... 2/170; 2/16; 2/DIG. 6

[58] Field of Search ..... 2/16, 170, DIG. 6, DIG. 11; 128/77

[56] References Cited

U.S. PATENT DOCUMENTS

| | | | |
|---|---|---|---|
| 215,671 | 5/1879 | Quosbarth | 2/170 |
| 856,282 | 6/1907 | Moss | 2/170 |
| 1,153,893 | 9/1915 | Conine | 2/170 |
| 1,189,198 | 6/1916 | Groome et al. | 2/170 |
| 1,221,513 | 4/1917 | Coyne | 2/170 |
| 3,256,882 | 6/1966 | Huber | 2/DIG. 6 X |
| 4,675,915 | 6/1987 | Siciliano | 2/DIG. 11 X |
| 4,698,852 | 10/1987 | Romero | 2/DIG. 11 X |

FOREIGN PATENT DOCUMENTS

| | | | |
|---|---|---|---|
| 597852 | 4/1978 | Switzerland | 2/DIG. 6 X |

OTHER PUBLICATIONS

"Velcro Product News", Aug. 1979, PN No. 59, p. 3.

*Primary Examiner*—Werner H. Schroeder
*Assistant Examiner*—Sara M. Current
*Attorney, Agent, or Firm*—Charles C. Corbin

[57] ABSTRACT

Disclosed is a protective wrist band having a composite body adapted to extend around a wearer's wrist and having complementary connector means on opposite ends for releasably holding the band around the wrist. The wrist band body has an inner layer of a porous, absorbent, fabric material and a significantly thicker shock-absorbing outer layer of a resilient, fluid-impervious, rubber-like closed cell material.

1 Claim, 1 Drawing Sheet

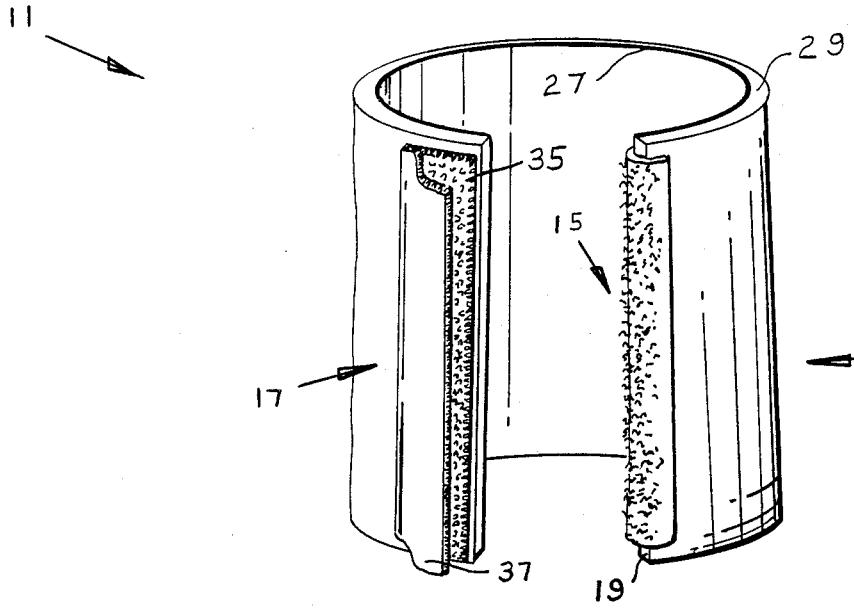
Fig. 1
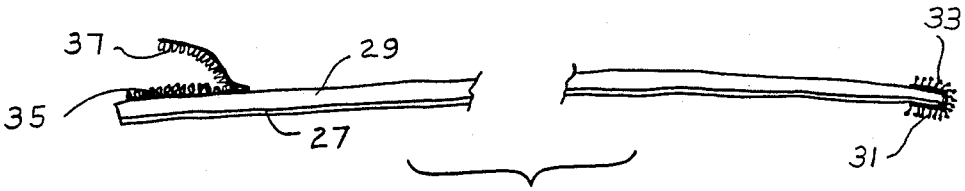
Fig. 3
Fig. 2
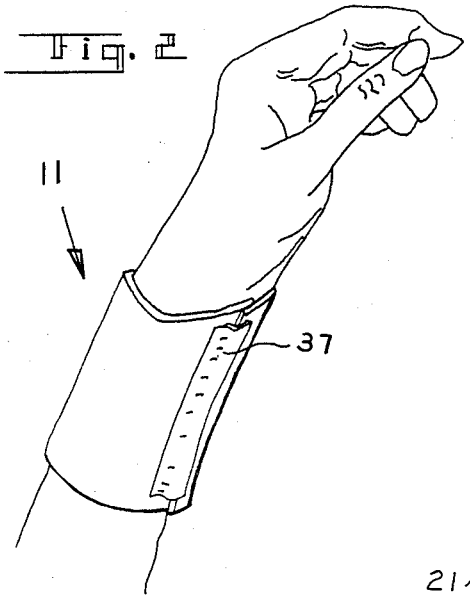
Fig. 4
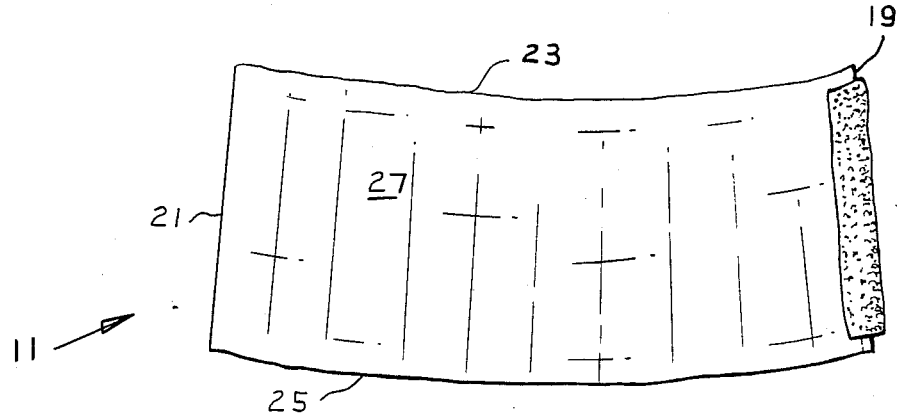

PROTECTIVE WRIST BAND

BACKGROUND

This invention relates to protective devices for a wearer's wrists, and particularly relates to flexible, resilient devices for protecting a mechanic's wrists.

A mechanic engaged in repair and maintenance work typically will be required to reach into engine compartments and the like, with hand-held tools. He must often manipulate his tools under confined space conditions and sometimes in hard-to-reach and hard-to-see areas. During such work the mechanic's wrist area is susceptible to collision with hard blunt metal surfaces as well as sharp edges, resulting in abrasions, cuts and bruises. There is also a hazard of burns to the wrist area caused by contact with hot engine surfaces, hot fluids or corrosive liquids. Work gloves protect the user's hand and knuckles but will not suffice to prevent harm to the mechanic's wrist region and the accompanying pain, annoyance and loss of productivity.

SUMMARY OF THE INVENTION

In view of the foregoing and the concern for preserving one of a mechanic's most vital facilities—the ability to handle tools—it is a general object of the present invention to provide a device which protects and cushions one's wrist area from abrasion due to collision with hard surfaces.

Another object is to provide a device which shields the wrist from contact with hot surfaces and hot or corrosive liquids.

A further object is to provide a device that shields the wrist area from grease, oil and dirt.

A still further object is to provide a novel wrist protector that has a simple yet sturdy construction that lends itself to being fairly inexpensively produced.

Accordingly these objects and additional advantages such as thermal insulation of the wrist region are achievable by the present invention which includes an open-ended flexible and resilient band of composite material that has opposite ends equipped with complementary fastening means. The band is adapted to extend around and embrace the wrist when its opposite ends are releasably fastened. The protective band has an inner layer of porous, absorbent, fibrous, fabric material and a substantially thicker outer layer of a resilient, fluid-impermeable, rubber-like material. The fastening means on one end of the band comprises a strip of hook type fasteners that extend from a portion of the outer layer, around the band edge and to a portion of the inner layer. The fastening means at the other end of the band comprises a complimentary arrangement of loop type material including a hinged portion and is adapted to engage all parts of the strip of hook type fasteners.

BRIEF DESCRIPTION OF THE DRAWINGS

FIG. 1 is a perspective view of a protective wrist band constructed according to the present invention;

FIG. 2 is a view showing the protective wrist band of the invention mounted on a person's wrist;

FIG. 3 is a top view of the protective wrist band of FIG. 1; and

FIG. 4 is an elevational view showing the inside of a wrist band according to the invention in an extended position.

DETAILED DESCRIPTION OF INVENTION

Referring now to the drawings, FIG. 1 shows a preferred embodiment of the present invention in the form of wrist protector 11 which features a main protective body 13, and fastening means connected thereto which comprises a first connector element 15 and a second, complementary connector element 17. Main body 13 is constructed of a sheet of resilient composite material, to be described, which has a first edge 19 and opposite, second edge 21. Body 13 also has a top edge 23 and a somewhat longer bottom edge 25, which edges, as FIG. 4 shows, have upwardly facing arcuate contours. This allows protector 11, when applied around a wrist in a manner to be described hereinafter, to assume a configuration which follows the generally tapered contour of the human wrist.

Body 13 has a composite construction which, as best shown in FIG. 3 includes an inner layer 27 and an outer layer 29. The skin-contacting inner layer 27 is a fibrous, fabric material that is, absorbent, porous and of good hand. This layer will "breathe" which will contribute to a wearer's comfort by preventing accumulation of perspiration and heat build-up at the interface of wrist and protector 11. A most suitable material for inner layer 27 is that known in the trade as terry cloth.

The outer layer 29 is substantially thicker than layer 27, and comprises a non-porous, closed-cell rubber-like material which is sufficiently thick and dense to function as a shock-absorbing cushion. It is also impermeable to liquids and resistant to petroleum products such as oils and grease. The preferred material is also a good insulator which will be effective to help prevent body heat loss through the wrist area in cold environments as well as serving as a heat shield to protect the wrist from contact with hot surfaces and fluids. A suitable material for the outer layer 29 is closed cell neoprene rubber, with a density of about 10.0 to 12.0 pcf. The layers 27 and 29 may be joined to form the composite band 13 by any of well known processes such as bonding, cementing or vulcanizing. During formation of composite band 13 it is further preferred to impart it with a residual bias which tends to resiliently hold it in the generally tubular configuration shown in FIG. 1. This will facilitate applying protector 11 around the wrist. It is noted that there are neoprene and fabric laminates that may be quite suited for the invention, and which are commercially available under the trademark RUBATEX.

The first and second connector elements 15 and 17 represent complementary parts of known hook-and-loop fastening material systems such as that marketed under the trademark VELCRO. First connector element 15 is preferably a strip of hook material which extends from engagement with the inner layer 27, completely around edge 19 and into engagement with a part of the outer layer 29. When secured in this manner by stitching of other typical means, the connector element 15 will feature an inner portion 31 and an outer portion 33.

Connector element 17 is preferably comprised of strips of loop material, and includes a first strip 35 which is secured flush against the surface of outer layer 29 by stitching or other means as indicated in FIG. 3. A second strip 37 of loop material is stitched along one of its edges to form a hinge which allows it to function as a flap. It is to be understood that element 15 may be also comprised of loop material and element 17 comprised of hook material.

When protector 11 is to be mounted to one's wrist it is laid therearound and connector element 15 is somewhat stretched into contact with element 17, with initial fastening contact being made when the inner portion 31 of the hook material is pressed against the first strip 35 of loop material (as flap 37 is held open). Fastening is complete, as illustrated in FIG. 2, when flap 37 is closed into engagement with the outer portion 33 of connector 15. This results in a connection which is stable, as well as secure, since the body 13 is held under fairly even tension.

While there has been described herein particular embodiments of the invention, it will be obvious to those skilled in the art that various changes and modifications may be made therein without departing from the invention, and therefore it is aimed to cover all such changes as fall within the true spirit and scope of the invention.

What is claimed is:

1. Device for protecting a wearer's wrist, comprising a flexible, resilient open-ended band that has a composite structure including an inner layer of a porous, absorbent fibrous fabric material, and a substantially thicker outer layer of a resilient, liquid-impervious closed-cell rubber-like material; a first connector element being affixed to one end of said band and a complementary second connector element affixed to the opposite ned of said band, said first and second connectors being releasably fastenable to each other so as to secure said band around the user's wrist; and wherein said first connector element comprises a strip of hook type fasteners that extends around the edge of the first end of said band so as to provide portions on the inside and outside of said first end, and said second connector element comprises a first strip of loop type fasteners secured to said opposite band end and a second strip of loop type fasteners that are hingedly secured adjacent said first strip, whereby connection of said first and second elements brings said inside portions of said hook type strip into engagement with said first strip of loop type fasteners and brings said outside portions into engagement with said second loop type strip.

* * * * *